US008478463B2

(12) United States Patent
Knott et al.

(10) Patent No.: US 8,478,463 B2
(45) Date of Patent: Jul. 2, 2013

(54) TRAIN CONTROL METHOD AND SYSTEM

(75) Inventors: Jeffrey G. Knott, Marion, IA (US); Steve R. Graham, Anamosa, IA (US); Ann K. Grimm, Cedar Rapids, IA (US); James H. Moore, Cedar Rapids, IA (US); M. Frank Wilson, Cedar Rapids, IA (US); Jeffrey D. Kernwein, Cedar Rapids, IA (US)

(73) Assignee: Wabtec Holding Corp., Wilmerding, PA (US)

( * ) Notice: Subject to any disclaimer, the term of this patent is extended or adjusted under 35 U.S.C. 154(b) by 1251 days.

(21) Appl. No.: 12/207,012

(22) Filed: Sep. 9, 2008

(65) Prior Publication Data

US 2010/0063656 A1 Mar. 11, 2010

(51) Int. Cl.

| | |
|---|---|
| ***B61L 21/04*** | (2006.01) |
| ***B61L 23/00*** | (2006.01) |
| ***B61L 27/04*** | (2006.01) |
| ***G05D 1/00*** | (2006.01) |
| ***G06F 17/00*** | (2006.01) |

(52) U.S. Cl.

USPC ..... 701/20; 701/70; 701/96; 701/117; 340/905; 246/23; 246/27; 246/167 R; 246/177

(58) Field of Classification Search

USPC ..... 701/19, 20, 200, 207, 208, 213, 300, 701/1, 36, 70, 93, 96, 117, 400, 408, 412, 701/414, 301; 246/20–23, 27, 62, 167, 176–178, 246/28 R, 96, 97; 340/901, 903, 905

See application file for complete search history.

(56) References Cited

U.S. PATENT DOCUMENTS

| | | | |
|---|---|---|---|
| 4,196,412 | A | 4/1980 | Sluis et al. |
| 5,437,422 | A | 8/1995 | Newman |
| 5,452,870 | A | 9/1995 | Heggestad |
| 6,112,142 | A | 8/2000 | Shockley et al. |
| 6,609,049 | B1 | 8/2003 | Kane et al. |
| 6,688,561 | B2 | 2/2004 | Mollet et al. |
| 6,824,110 | B2 | 11/2004 | Kane et al. |
| 6,845,953 | B2 | 1/2005 | Kane et al. |
| 6,853,888 | B2 | 2/2005 | Kane et al. |
| 6,863,246 | B2 | 3/2005 | Kane et al. |
| 6,865,454 | B2 | 3/2005 | Kane et al. |
| 6,903,658 | B2 | 6/2005 | Kane et al. |
| 6,957,131 | B2 | 10/2005 | Kane et al. |
| 6,996,461 | B2 | 2/2006 | Kane et al. |
| 7,036,774 | B2 | 5/2006 | Kane et al. |
| 7,089,093 | B2 | 8/2006 | Lacote et al. |
| 7,236,860 | B2 | 6/2007 | Kane et al. |
| 2004/0006413 | A1 | 1/2004 | Kane et al. |

(Continued)

FOREIGN PATENT DOCUMENTS

| | | | |
|---|---|---|---|
| KR | 100316621 | B1 | 2/2002 |

(Continued)

*Primary Examiner* — Thomas Tarcza
*Assistant Examiner* — Edward Pipala
(74) *Attorney, Agent, or Firm* — The Webb Law Firm

(57) ABSTRACT

A train control system for controlling trains traveling in a track network including tracks with signals associated therewith. The system includes an on-board track database, a positioning system and an on-board control system. The on-board control system receives position data and automatically brakes the train prior to encountering an upcoming signal based upon specified data points. The train is not automatically braked if certain conditions are met. A method for controlling a train traveling in a track network is also disclosed.

24 Claims, 2 Drawing Sheets

U.S. PATENT DOCUMENTS

| | | | |
|---|---|---|---|
| 2004/0182970 | A1 | 9/2004 | Mollet et al. |
| 2005/0110628 | A1 | 5/2005 | Kernwein et al. |
| 2006/0015224 | A1 | 1/2006 | Hilleary |
| 2006/0080009 | A1 | 4/2006 | Kane et al. |

FOREIGN PATENT DOCUMENTS

| | | | |
|---|---|---|---|
| KR | 1020040023786 | A | 3/2004 |
| KR | 1020050001325 | A | 1/2005 |
| KR | 100697303 | B1 | 3/2007 |
| WO | 2005066731 | A1 | 7/2005 |

TRAIN CONTROL METHOD AND SYSTEM

BACKGROUND OF THE INVENTION

1. Field of the Invention

The present invention relates generally to methods, systems and apparatus for controlling trains traveling in a track network made up of multiple tracks with signals associated with portions of the track and, in particular, to a system and method of controlling a train by predictively enforcing signal aspects as the train is moving through the track network.

2. Description of Related Art

As is known in the art, train control systems are used for monitoring, tracking and operating trains traversing tracks throughout a track network. In order to make appropriate train control decisions regarding how the train should be operated, whether manually, automatically or semi-automatically, important information and data must be obtained. In addition, and in order to provide for safe traffic control and avoid accidents or collisions, signals are provided throughout the track network, and each signal is typically associated with a block or section of track. The aspects of these signals are normally generated by the wayside signals and communicated to the train, where some signal or other indication is provided to the train operator regarding upcoming track signal aspects and track status.

In one example of the prior art, certain wayside signals, e.g., permissive signals, are positioned along the track, and the portion of track may be in a territory where cab signals can be obtained or generated. These cab signals (or on-board signals) provide the current wayside signal indication, and often provided in a territory equipped for such operation where wayside signals are positioned along the track. Various mechanisms and communication systems may be provided or used to transmit the signal indication or aspect from the upcoming wayside signal to the train.

Normally, automatic cab signal systems are implemented in a territory equipped with track circuits for train detection, including logic controllers that can determine the proper signal indication to display and provide for communication between adjacent logic controllers via the track rails. In addition, the locomotives or trains are equipped to receive indications from the track rails, and indicator units displaying the signal indications to the train engineer or operator, such as via a visual display or the like. A permissive signal is a signal where the "stop" indication means "stop and proceed at restricted speed." Usually identified by a number plate, some permissive signals also have a plate with a letter "G," indicating that the train may pass a signal having this "stop" aspect without stopping, but at restricted speed. Further, this "stop" aspect or indication may also be an absolute signal that requires the operator stop the train and proceed only with authority from dispatch.

It should be noted that many, but not all, cab signal-equipped territories include wayside signal heads of the color-light variety. In such systems: (1) a "clear" signal displays green and indicates that it is safe to proceed; (2) an "advance approach" signal is flashing yellow and indicates that the train may proceed but should be prepared to stop at the second upcoming wayside signal; (3) an "approach" signal is solid yellow, and indicates that the train can proceed but should be prepared to stop before any part of the train or engine passes the next signal; and (4) a "stop and proceed" signal is red, and indicates that the train should stop before any part of the train or engine passes the signal, and should then proceed at restricted speed to the next signal.

These wayside signal indications or aspects have corresponding signal indications or aspects in the cab or in an on-board location. In particular, known cab signals include: (1) a "restricting" signal that is half red and half yellow and indicates that the train should proceed at restricted speed; (2) an "approach" signal that is solid yellow and indicates that the train can proceed, but should be prepared to stop before any part of the train or engine passes the next signal; (3) an "advance approach" signal that is half yellow and half green and indicates that the train can proceed, but should be prepared to stop at the second signal; and (4) a "clear" signal that is solid green and indicates that the train may proceed as normal.

In operation and under some conditions, a train may be following another train, and can encounter a sequence of signals indicating "approach," "advance approach," "approach," etc., which tends to lulls the train operator into a lower state of vigilance. After encountering a number of these "approach"/"advance approach" cyclical indications, the train may next encounter a signal indicating "stop and proceed." One typical reason for this "stop and proceed" signal is that another train is occupying the next, upcoming track circuit or block. This problem is further exacerbated in cab signal territory, where in certain scenarios the "approach" indications will upgrade to the less restrictive "advance approach" signal indication. When the operator is lulled into a lower state of vigilance, he or she may not be operating the train in an appropriate manner to comply with the next, upcoming wayside signal aspect, e.g., "stop and proceed." Therefore, due to this diminished state of vigilance, accidents or collisions may occur between trains (or other similar non-compliance issues may arise with respect to the next, upcoming signal).

FIGS. 1 and 2 illustrate the operation of two trains TR1, TR2 proceeding along a track T in a track network TN, where multiple wayside signals S are positioned along the track T, and a cab signal S is provided to the operator in the train TR1, TR2. With reference to FIG. 1(*a*), the cab signal S in the train TR1 indicates "clear," and this train TR1 is approaching a wayside signal S that also indicates "clear." This wayside signal S is the source of information to the cab signal equipment of train TR1 and provides a "clear" indication. Train TR2 is stopped just after passing a wayside signal S, which now provides a signal indication or aspect of "stop and proceed" to trains following train TR2, e.g., train TR1. The cab signal equipment of train TR2 indicates "clear."

In FIG. 1(*b*), train TR1 has passed the second wayside signal S, thus "knocking it down" to a "stop and proceed" indication for trains following train TR1. Further, train TR1 cab signal S indicates "clear," and train TR1 is approaching a flashing yellow wayside signal S, indicating "advance approach." This wayside signal S is the source of information to the train TR1 cab signal system. It should be recognized that "advance approach" means that the crew should be prepared to stop at the second wayside signal S in the forward direction, which is the wayside signal S that train TR2 has just passed.

In FIG. 1(*c*), train TR1 has passed the "advance approach" wayside signal S, knocking it down to "stop and proceed." Also, train TR1 cab signal system indicates "advance approach." Train TR1 is now approaching a wayside signal S indicating "approach," which means that the crew must be prepared to stop before passing the next wayside signal S. In FIG. 1(*d*), train TR1 has passed the wayside signal S previously indicating "approach," thus knocking it down, and is now approaching a wayside signal S indicating "stop and proceed." Train TR1 cab signal system now displays "approach," which again means that the crew must be prepared to stop the train before passing the next, upcoming wayside signal.

Finally, in FIG. 1(*e*), train TR1 has stopped before passing the next wayside signal S, which indicates "stop and proceed." Therefore, no collision or other issue has arisen, since train TR2 has stopped on a specific portion or section of track, and the signal indication or aspect provided to train TR1 continually downgraded as train TR1 approached train TR2, culminating in the "stop and proceed" indication, which is easily complied with based upon the gradual and downgraded nature of the signal S indications.

In another example, and as illustrated in FIG. 2, train TR1 is following train TR2, and train TR2 is initially moving. As seen in FIG. 2(*a*), train TR1 cab signal system is indicating "advance approach," and is nearing a wayside signal S indicating "approach," which, as discussed, means train TR1 must be prepared to stop before passing the next wayside signal S (which, in this example, is indicating "stop and proceed"). Train TR2 is also moving, and its cab signal system is indicating "clear."

In FIG. 2(*b*), train TR1 has passed a wayside signal S, knocking it down to "stop and proceed," and train TR1 cab signal system now indicates "approach." The next wayside signal is indicating "stop and proceed." In FIG. 2(*c*), train TR2 has advanced far enough that the rearward wayside signal S has improved from "stop and proceed" to "approach." This, in turn, upgrades the train TR1 cab signal indication to "advance approach." In FIG. 2(*d*), train TR1 has passed the next wayside signal S, and train TR1 cab signal system now indicates "approach." Train TR2 has stopped just past a wayside signal S.

This sequence of events may repeat a number of times, with train TR1 cab signal system alternatively indicating "advance approach," "approach," "advance approach," "approach," etc. Further, it is this sequence of events that may cause the operator of the train TR1 to become complacent. In particular, the crew expects train TR2 to continue moving, and therefore expects the signal indication in train TR1 cab signal system to continue cycling between "approach" to "advance approach."

However, and as illustrated in FIG. 2(*e*), and due to the stoppage of train TR2, train TR1 is now approaching a wayside signal S indicating "stop and proceed," which requires that the train TR1 stop before any part of the train TR1 or engine passes the signal S, and then to proceed at restricted speed to the next signal S. However, the crew or operator may not be prepared to stop the train TR1 before passing this next, upcoming wayside signal S, since they are expecting the train TR1 cab signal indication to upgrade to "advance approach." Not being able to stop in time, train TR1 will collide with train TR2.

There are available different systems and methods for communicating with wayside equipment implementing safety features and controlling trains as they travel through the track network. For example, one or more of the following patents/publications describe train monitoring, control and/or safety systems or functions for use in operating a train in a train network: U.S. Pat. Nos. 7,236,860; 7,036,774; 6,996,461; 6,957,131; 6,903,658; 6,865,454; 6,863,246; 6,853,888; 6,845,953; 6,824,110; 6,609,049, all to Kane et al.; U.S. Pat. No. 6,688,561 to Mollet et al.; U.S. Pat. No. 5,452,870 to Heggestad; U.S. Pat. No. 6,112,142 to Shockley et al.; U.S. Pat. No. 4,196,412 to Sluis et al.; and Publication Nos.: 2006/0080009 to Kane et al.; 2006/0015224 to Hilleary; 2005/0110628 to Kemwein et al.; 2004/0182970 to Mollet et al.; and WO 2005/066731 to Kane et al.

These prior art systems and methods exhibit various drawbacks and deficiencies. Further, many of these prior art systems are amenable to further augmentation or beneficial, functional enhancements in order to provide increased vigilance and maintenance of safe conditions at various portions along the track in the track network. In addition, there remains a need in the art for increasing operator vigilance, thus enhancing the safety of trains traveling within the track network and for providing protection of the operators, crew, pedestrians, motorists, etc.

SUMMARY OF THE INVENTION

It is, therefore, an object of the present invention to provide a method and system for controlling a train that overcomes the drawbacks and deficiencies in the art of train control systems and the like. It is another object of the present invention to provide a method and system for controlling trains for predictively enforcing a stop for a train traveling in a track network and based upon signal aspect information. It is a further object of the present invention to provide a method and system for controlling trains that enhances the safety of trains traveling in a track network by enforcing or braking trains in certain situations. It is yet another object of the present invention to provide a method and system for controlling trains that protects against the train operator incorrectly assuming or guessing the signal aspect of an upcoming signal.

Therefore, according to the present invention, provided is a train control system for controlling at least one train traveling in a track network, where the track network includes at least one track having at least one signal associated with a portion of the track. The system includes an on-board track database that includes train data, track network data, track data and/or signal data. A positioning system determines position data directed to a position of the at least one train within the track network. An on-board control system is provided and programmed to: (i) receive position data from the positioning system and signal data from the track database; and (ii) based upon at least one of the train data, track network data, track data, position data, signal data, train control data, authorization data and/or signal aspect data, automatically brake the train prior to encountering a next, upcoming signal, unless: (a) signal aspect data indicates that it is safe to proceed; (b) specified authorization data is received; or (c) specified train control data is received.

According to the present invention, also provided is a method for controlling at least one train traveling in a track network, where the track network includes at least one track having at least one signal associated with a portion of the track. The method includes: determining train data, track network data, track data and/or signal data; determining position data directed to a position of the at least one train within a track network; and based upon train data, track network data, track data, position data, signal data, train control data, authorization data and/or signal aspect data, automatically brake the train prior to encountering a next, upcoming signal, unless: (a) signal aspect data indicates that it is safe to proceed; (b) specified authorization data is received; or (c) specified train control data is received.

In another aspect of the present invention, provided is a train control system for predictively enforcing a stop for at least one train traveling a track network having at least one track with at least one signal associated with a portion of the track. The system includes an on-board control system programmed to: (i) receive train position data and signal data; and (ii) based upon train data, track network data, track data, position data, signal data, train control data, authorization data and/or signal aspect data, automatically stop the train prior to encountering a next, upcoming signal, unless: (a) signal aspect data indicates that it is safe to proceed; (b) specified authorization data is received; or (c) specified train control data is received.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

According to the present invention, provided is a method and system 10 for controlling at least one train TR traveling in a track network TN. The track network TN includes or is made up of multiple interconnected tracks T, and wayside signals S are associated with specific portions, e.g., blocks, of track T. For example, such portions of the track T are usually referred to as blocks, sections or circuits, and the associated signal S is positioned at the beginning of the block and provides information, aspects or indications related thereto.

It should be noted that the term "aspect" when used in connection with "signal aspect data" specifically includes any type, configuration and format of information representing the condition or state of the signal itself or an indication of an action to be taken by an operator based upon the state or condition of the upcoming section of track T. For example, the "aspect" may be a color or pattern of signal lamps positioned at or near the track T. Further, this "aspect" may be an indication of the action an operator should take in connection with the train TR, e.g., "stop and proceed," etc, which is directly related to the upcoming section of track T. Accordingly, in one embodiment, this "aspect" is associated with the signal state or condition, which represents the state or condition of the upcoming section of track T. In another embodiment, this "aspect" is an indication of an action to be taken by the operator (or automatically by an onboard control system), and, again, this action is directly associated with the state or condition of the upcoming section of track T. All such information and data is included in connection with the "signal aspect data," as used herein.

Figure 3:
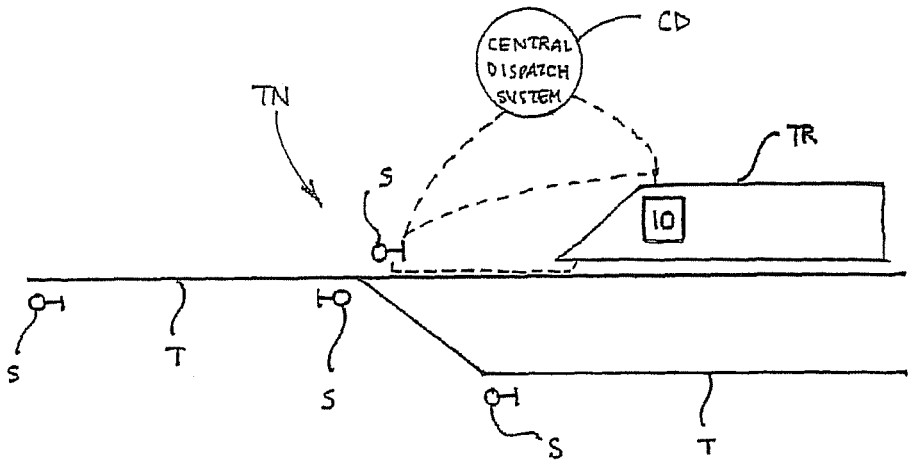
FIG. 3 is a schematic view of a method and system for train control according to the principles of the present invention.

As is known in the art, and as discussed above in detail, the indication or aspect associated with the wayside signal S provides required information and data for making control decisions regarding the train TR as it approaches this next, upcoming block or portion of track T. The signal aspect or indication can be communicated to the train TR in a variety of known manners. For example, and as illustrated in FIG. 3, signal aspect or indication data can be transferred or communicated from the wayside signal S to the train TR via the rails of the track T, wirelessly directly to the train TR and/or wirelessly to the train TR via a central dispatch system CD. Using any of these communication techniques, this important data regarding the upcoming signal S (and, thus, the status of the block of track T associated therewith), the system 10 of the present invention makes appropriate and automated decisions regarding control, enforcement and other similar functions on the train TR.

As is also known in the art, in certain territories, the signal indication or data is provided directly to the cab of the train TR. Regardless, the information and signal aspect with respect to the upcoming blocks or portions of track T are provided to the operator of the train TR to provide for the safe operation and handling of the train TR, and similar control decisions. However, even when the information and data regarding the signal aspect for the upcoming portion of track T is correct and appropriately communicated to the train TR, and based upon the nature of a system under human control and manual operation, situations arise that lead to complacency and other human error. Such a situation has been discussed above, and is illustrated in FIG. 2.

The system 10 of the present invention can be implemented and utilized to avoid such situations, while still allowing the train TR to be operated by the human engineer or crew under specific conditions. Accordingly, the present method and system 10 is not focused upon the automatic control of the train TR during normal operation throughout the track network TN, and instead is directed to specific situations where operator vigilance may become reduced, which may result in non-compliance with an upcoming aspect or indication of the next, upcoming signal S.

Figure 4:
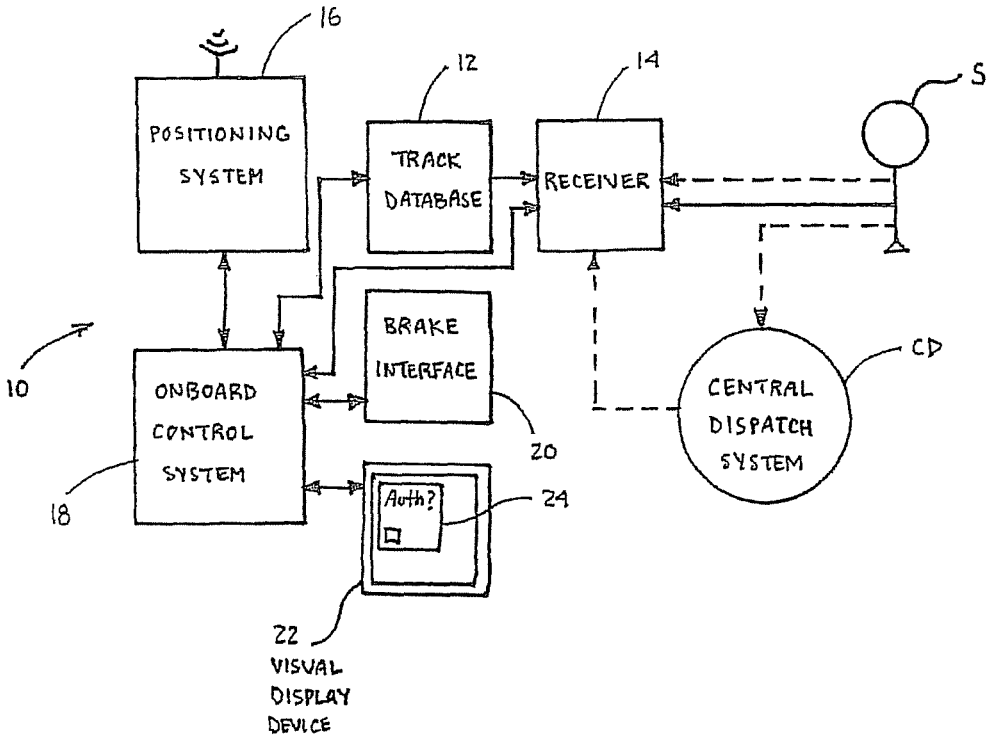
FIG. 4 is a schematic view of one embodiment of a method and system for controlling trains according to the principles of the present invention.

An exemplary embodiment of the system 10 is illustrated in schematic form in FIG. 4. In this embodiment of the present invention, the train control system 10 includes an on-board track database 12, and this database 12 is populated or capable of being populated with various data points and fields, including train data, track network data, track data and/or signal data. Although the database 12 may be referred to as the "track" database 12 herein, this should not be construed as limiting the nature or type of data populated in this database 12. As stated above, the data may include train, track, system and/or signal data. The train data may include various data points and fields relating to the train TR, operating parameters of the train TR, features or components of the train TR, information or data directed to other trains TR in the track network TN, etc. Track network data may include any data or information relating to the track network TN and information regarding this track network TN, and track data includes data points and information specifically directed to the track T, such as block data, portion data, section of track T data or other information regarding a specific area or portion of track T. Signal data includes information regarding the location, operation, aspect, indication or other parameter associated with a specific signal S, whether a wayside signal S or an on-board cab signal S (as displayed to the operator).

The information and data included in the on-board track database 12 may be generated internally by the train TR or otherwise provided to the train TR via other sources, e.g., from the central dispatch system CD, directly from the wayside signal S, in a hardwired form (via the rails), in a wireless form from the wayside signal S or central dispatch system CD, etc. Accordingly, the data fields and information in the track database 12 can be updated through a variety of means, and this data can be dynamically updated or updated in batch form from communications through the central dispatch system CD.

In order to obtain data from the wayside signal S or central dispatch system CD, and in one non-limiting embodiment, the system 10 includes a receiver 14. The type of receiver 14 depends upon how the information and the data for populating the track database 12 is obtained, e.g., wireless, through the rails, etc. However, it is envisioned that any such receiver 14 is appropriate of picking up or otherwise obtaining a signal (or the signal data) from the wayside signal S, as well as any other data or information regarding the train TR, the track T, the track network TN, etc. from the central dispatch system CD. Of course, and as discussed, some of this information, e.g., train data, track network data, track data, may be prepopulated in the track database 12 and may not necessarily be required to be dynamically updated through information received at the receiver 14.

The system 10 of the present invention also includes a positioning system 16 for determining position data directed to a location of the train TR within the track network TN. This positioning system 16 may be a Global Positioning System (GPS) or other similar system configured or adapted to determine and provide the estimated position of the train TR on the track T in the track network TN.

The system 10 also includes an on-board control system 18. This on-board control system 18 is programmed, configured or adapted to receive the position data from the positioning system 16, as well as signal data from the track database 12. Further, and based upon the train data, track network data, track data, position data, signal data, train control data, authorization data and/or signal aspect data, the on-board control system 18 is programmed, configured or adapted to automatically brake the train TR prior to encountering a next, upcoming signal S. In particular, and in order to brake the train TR, the on-board control system 18 is in communication with a brake interface 20, which is able to implement the "brake" or "stop" command from the on-board control system 18 and enforce a complete stop of the train TR.

However, it should be noted that the system 10 of the present invention does not automatically stop the train TR in every situation, since, as discussed above, the goal of the present invention is to permit the human operator to have as much control over the train TR as possible. Accordingly, the train TR is not automatically braked or stopped if any one of three conditions is met: (1) the signal aspect data for the next, upcoming signal indicates that it is safe for the train TR to proceed; (2) specified authorization data is received; or (3) specified train control data is received. Accordingly, if the appropriate data and information is received by the on-board control system 18 prior to the train TR reaching the threshold where the train TR would need to be stopped (such that no part of the train TR or engine enters the next portion of track T), and any one of the three above-described conditions are met, the train TR will not be automatically braked and will be allowed to proceed.

The signal data used in making the appropriate control decisions within the context of the present system 10 can be a variety of signal types, such as a cab signal S, a wayside signal S, a permissive signal S, an absolute signal S, a monitored signal S, an unmonitored signal S, a signal S associated with a control point, etc. Based upon the signal data obtained through any of these signals S, the train control system 10 of the present invention enforces or brakes the train TR to a complete stop in an automatic manner, unless certain other appropriate data points are obtained or other actions are undertaken by the operator.

In one preferred and non-limiting embodiment, the on-board control system 18 is further programmed, configured or adapted to receive or generate cab signal aspect data, and set the signal aspect data for an upcoming wayside signal S to "stop and proceed" (where the operator must fully stop the train TR and then may proceed) or "stop" (wherein the train operator must fully stop the train TR and may only proceed with authority from dispatch). For example, if the current cab signal indication is "approach" or "restricting," and the train TR is approaching an unmonitored wayside permissive signal S (which is set or assumed to be indicating "stop and proceed"), the system 10 will predictively enforce a "stop and proceed" at the location of the wayside signal S. Further, it is also envisioned that the system 10 will predictively enforce a "stop," where only a direct communication from dispatch will permit the operator to safely proceed. In particular, the system understands the location of train TR via the position data from the positioning system 16, as well as the location of the upcoming wayside signal S via the signal data and the track database 12 (which includes the location of these wayside signals S). Accordingly, and since the wayside signal S is unmonitored, regardless of the cab signal S, the system 10 assumes the next, upcoming wayside signal S to be "stop and proceed," unless the various conditions are met (as briefly discussed above and as described in greater detail hereinafter).

In this embodiment, the train TR will not be automatically braked if specified authorization data is received by or communicated to the on-board control system 18. Specifically, and as illustrated in FIG. 4, the system 10 may also include a visual display device 22 in communication with the on-board control system 18. The specified authorization data may be in the form of a data input recognizable by the on-board control system 18. For example, the data input may be provided to the on-board control system 18 through a selectable portion 24, which is presented to the operator on the visual display device 22. For example, a prompt may be provided to the operator on the visual display device 22 requesting whether the operator or crew is allowed to operate the train TR without stopping. In one example, the query may request that the operator acknowledge that he or she "may pass signal without stopping" by pressing a selectable portion 24 in the form of a button on the visual display device 22.

In the embodiment where the on-board control system 18 predictively enforces the signal aspect data of the upcoming wayside signal S to "stop," the on-board control system 18 may require that the operator press a selectable portion 24 that indicates that appropriate authority has been received by the operator from central dispatch to proceed. Similarly, the on-board control system 18 may be configured to receive or intercept this communication or authorization directly from central dispatch or the central dispatch system CD, and act accordingly, i.e., permitting or preventing the train TR from proceeding.

In another embodiment, the on-board control system 18 may refrain from automatically braking the train TR based upon train control data (or, as discussed above, the receipt or processing of a communication of authority from central dispatch or the central dispatch system CD). In one preferred and non-limiting embodiment, train control data that indicates that the train TR has been appropriately stopped within a predetermined distance from the upcoming signal S may indicate to the on-board control system 18 that the train TR is being operated in a compliant manner, and the operator has not lost vigilance. Still further, the train control data indicating the operational speed of the train TR may also be used as a basis of deciding whether or not to automatically brake the train TR. For example, in some instances, a train TR is permitted to move through a "stop and proceed" signal S if the train TR has been fully stopped, and is proceeding at restricted speed thereafter through the signal S. Therefore, the on-board control system 18 may also refrain from automatically braking the train TR if the train control data indicates that the operator is operating the train TR at the appropriate specified or restricted speed within a predetermined distance from the upcoming signal S. It is also envisioned that the speed of the train TR can be monitored in a variety of situations and used as a basis for making train control decisions within the system 10 of the present invention.

In another embodiment, the system 10 is useful when operating in a track network TN where the tracks T are equipped with monitored, absolute signals, typically, accomplished through a code line interface. In this situation, when the train TR is approaching an absolute signal S known to be indicating "stop," or if the signal aspect data is unknown or unavailable, the system 10 will predictively enforce a stop and automatically brake the train TR. However, and again, the on-board control system 18 may refrain from automatically braking the train TR if specified authorization data is received from the operator of the train TR, if signal aspect data indicates that it is safe to proceed, or if specified train control data is received. For example, the on-board control system 18 would enforce compliance with an absolute signal S indicating "stop," but would not automatically brake the train if this indication changed and the information and signal data subsequently received by the receiver 14 and processed by the on-board control system 18 indicates that is now safe to proceed. Further, and as discussed above, if the operator appropriately stops the train TR within a predetermined distance of the upcoming, wayside signal S (and, normally, proceeds at restricted speed), no enforcement function will occur and the train TR would be allowed to proceed along its course. Also, and as discussed above, if an appropriate and specified authorization is received from the operator of the train TR, such as through the input data, the on-board control system 18 also refrains from automatically braking the train.

In another preferred and non-limiting embodiment, the system 10 may be used in signaled territory, where permissive signals S are equipped with signal monitors. If the train TR is approaching a permissive signal that is reporting or indicating "stop and proceed," or is not reporting a valid indication, the system will predictively enforce a "stop and proceed" at the location of the wayside signal S. However, in one instance, if the train control data indicates that the train TR has stopped within a specified distance in advance of the wayside signal S (and, preferably, is proceeding at restricted speed), the system 10 will not automatically brake the train TR. Further, even if the train TR is approaching the signal S at restricted speed, and within a distance in advance of the wayside signal S, a query or other indication may be provided to the operator on a visual display device 22 asking whether the train TR has authorization to proceed without stopping. It should be noted that there are some cases where the train TR is permitted to pass a permissive wayside signal S indicating "stop and proceed" without stopping. If the operator provides appropriate authorization information data to the on-board control system 18, enforcement will not occur.

The authorization data generated by the operator can be obtained in a variety of manners. For example, the operator may obtain specific authorization from the central dispatch system CD permitting the train TR to proceed without stopping prior to encountering the next, upcoming wayside signal S and entering the next portion of track T. Alternatively, the operator may obtain specific authorization to proceed after stopping at an absolute signal indicating "stop." In addition, and based upon the relative distances and speed of operation, in some case, the authorization data or indication generated by the operator may be based upon the operator's visual acuity, i.e., looking ahead and monitoring the situation using his or her eyes. In either case, the system 10 will provide a prompt or query (when appropriate) requesting whether the operator has obtained or can provide authorization to proceed through the signal S without first stopping.

The prompt or query provided to the operator on the visual display device 22 may only be provided or displayed after the on-board control system 18 processes appropriate information and data to ascertain whether the prompt or display is necessary. For example, if data indicating that the train TR has been stopped within a predetermined distance of the upcoming signal S and/or data indicating that the train TR is operating at a specified speed within a predetermined distance from the upcoming signal S is received, a prompt or query requesting authorization is unnecessary. However, based upon the configurable aspects of the system 10 of the present invention, any of these different situations can be addressed through the appropriate programming on the on-board control system 18, which assists in ensuring effective operation of the train TR and maximizing safety and precautions. Accordingly, the system 10 may enforce a "stop and proceed" indication with minimum crew interaction, and may permit the train TR to continue without stopping when the crew or operator appropriately interacts in the system 10.

The timing of providing the prompt or query to the operator may be adjusted for effective implementation. In addition, whether or not to display such a prompt or query is adjustable, and may include such a display regardless of whether or not the train TR has been stopped and/or is proceeding at restricted speed. Further, and in a situation where the train is proceeding at normal speed, the prompt or query would be displayed or presented to the operator according to a calculated braking curve or other algorithm that provides both time for the operator to respond to the prompt or query, as well as time to effectively and completely halt train TR movement prior to any part of the train TR or engine passing the next, upcoming signal S. In addition, this prompt or query may be combined with audible or visual alarms or other forms or formats for gaining the attention and vigilance of the operator.

It is further envisioned that multiple or a series of prompts or queries can be provided in association with or in addition to a cab signal aspect displayed on the visual display device 22. For example, the visual display device 22 may present data to the operator indicating the status or aspect of the upcoming signal S, as well as when automatic braking will be implemented. For example, the visual display device 22 may display a message that the signal status is unknown, the signal requires a stop, the signal requires a speed reduction, etc. Further, the query or prompt may request that the operator press a key only after receiving authorization to proceed, and if a key is not pressed, i.e., specified authorization data is not received, the train TR will be automatically braked. Such an implementation may also be used when the train TR has been automatically braked to a complete stop, but the operator wishes to proceed. In other words, the operator may still need to interact with or otherwise provide some data input to the on-board control system 18 or else, after the train TR begins to move, and based upon the calculations, it will again be stopped prior to encountering the next, upcoming signal S.

Figure 1:
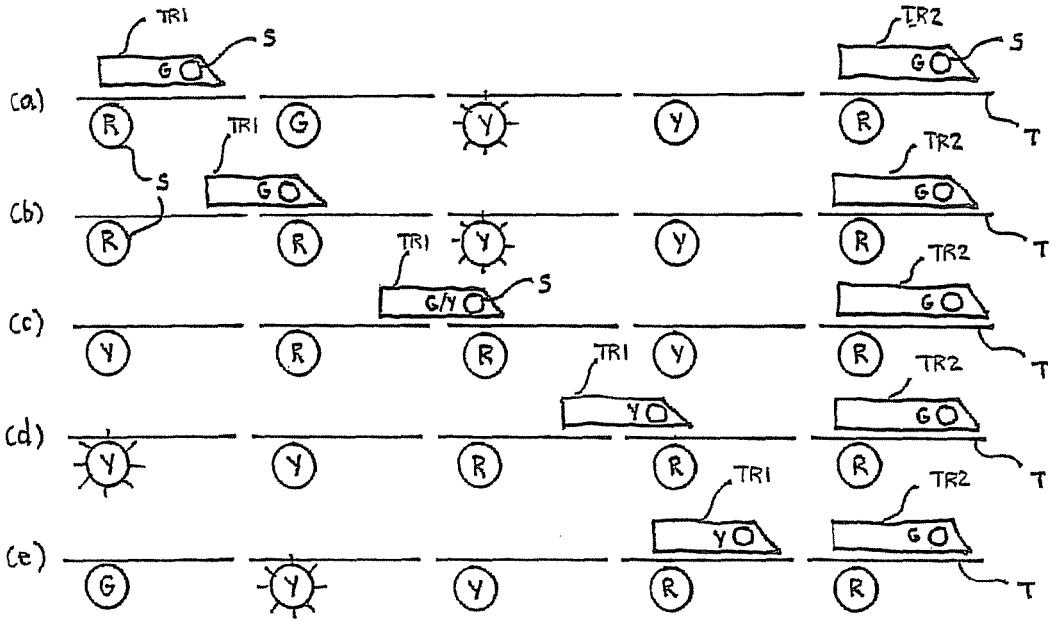
Fig. 1 (PRIOR ART)
FIG. 1 is a schematic view of trains traveling in a track network according to the prior art.
Figure 2:
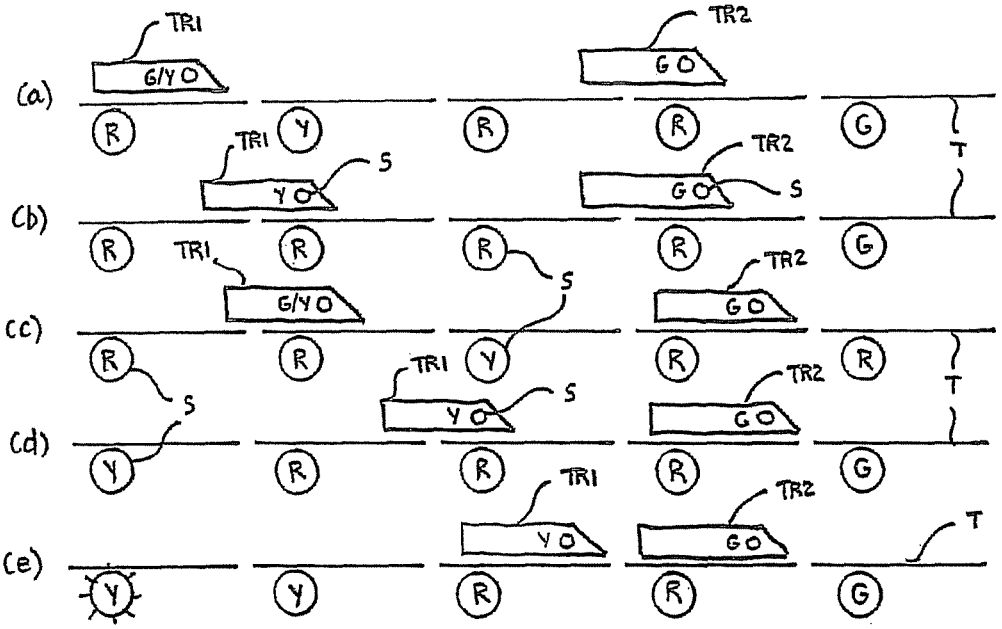
Fig. 2 (PRIOR ART)
FIG. 2 is a schematic view of trains traveling in a track network according to the prior art.

With reference to FIG. 2, by implementing the system 10 of the present invention, the collision that occurs between train TR1 and train TR2 would be avoided. In particular, even given the operator's diminished vigilance based upon the back and forth cycling of "approach" and "advance approach," the train TR1 would automatically be enforced to a stop via the on-board control system 18. In particular, and since train TR2 has stopped just beyond a wayside signal S (which is the next, upcoming signal of train TR1), train TR1 will be enforced or braked such that no part of the train TR1 moves beyond this signal S. If train TR1 was appropriately stopped and subsequently proceeding at restricted speed, no enforcement would be necessary until train TR1 reaches a threshold of stopping prior to passing the next signal S, which would result in a collision with train TR2. It may be assumed that while in some embodiments, a prompt or query may still be displayed to the operator on the visual display device 22, in such a situation, the timing of this prompt or query is such that the operator is given ample time to respond, as well as brake train TR1 to a complete stop.

In this manner, the present invention provides a method and system 10 for controlling multiple trains TR traversing tracks T within a track network TN. The present invention predictively enforces a stop, and automatically brakes the train TR to a complete resting position, unless certain conditions are satisfied. In particular, the train TR is not automatically braked or stopped if the received signal aspect data indicates that it is safe to proceed, specified authorization data is obtained or specified train control data is obtained. Therefore, the train will only be automatically braked if the operator has, indeed, lost vigilance or other problems have arisen. However, the train TR is not automatically braked if appropriately controlled, based upon a change in signal aspect or appropriate authorization is received. Accordingly, and by using the system 10 of the present invention, safety is enhanced throughout the track network TN, and collisions and other hazardous situations are reduced or eliminated.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A train control system for controlling at least one train travelling in a track network comprising at least one track having at least one signal associated with a portion of the at least one track, the system comprising:

an onboard track database comprising at least one of the following: train data, track network data, track data, signal data;

a positioning system configured to determine position data directed to a position of the at least one train within the track network; and an onboard control system configured to:

(i) receive position data from the positioning system and signal data from the track database; and (ii) based upon at least one of the following: train data, track network data, track data, position data, signal data, train control data, authorization data signal aspect data, or any combination thereof, predictively enforce the next, upcoming signal by automatically braking the at least one train prior to encountering the next, upcoming signal, unless: (a) based at least partially on current signal aspect data, a determination is made that it is safe to proceed towards the next, upcoming signal; (b) specified authorization data is received; or (c) specified train control data is received.

2. The train control system of claim 1, wherein the at least one signal is at least one of the following: a cab signal, a wayside signal, a permissive signal, an absolute signal, a monitored signal, an unmonitored signal, a signal associated with a control point.

3. The train control system of claim 1, wherein the onboard control system is further configured to: receive or generate cab signal aspect data; and set the signal aspect data for an upcoming wayside signal to "stop" or "stop and proceed".

4. The train control system of claim 3, wherein, based upon the receipt of specified authorization data from an operator of the train, the train is not automatically braked.

5. The train control system of claim 4, further comprising a visual display device in communication with the onboard control system, wherein the specified authorization data is in the form of a data input recognizable by the onboard control system.

6. The train control system of claim 5, wherein the data input is provided to the onboard control system through a selectable portion presented to the operator on the visual display device.

7. The train control system of claim 3, wherein, based upon train control data indicating that the train has been stopped within a predetermined distance from the upcoming signal, the train is not automatically braked.

8. The train control system of claim 7, wherein, further based upon train control data indicating that the train is operating at a specified speed within a predetermined distance from the upcoming signal, the train is not automatically braked.

9. The train control system of claim 3, wherein, based upon train control data indicating that the train is operating at a specified speed within a predetermined distance from the upcoming signal, the train is not automatically braked.

10. The train control system of claim 1, wherein the onboard control system is further configured to monitor the signal aspect data for an upcoming wayside signal.

11. The train control system of claim 10, wherein, if the signal aspect data indicates a "stop" or the signal aspect data is unknown, the train is automatically braked.

12. The train control system of claim 11, wherein the train is permitted to proceed only upon receipt of specified authorization data from an operator of the train or a central dispatch system.

13. The train control system of claim 10, wherein, based upon the receipt of specified authorization data from an operator of the train, the train is not automatically braked.

14. The train control system of claim 13, further comprising a visual display device in communication with the onboard control system, wherein the specified authorization data is in the form of a data input recognizable by the onboard control system.

15. The train control system of claim 14, wherein the data input is provided to the onboard control system through a selectable portion presented to the operator on the visual display device.

16. The train control system of claim 10, wherein, based upon train control data indicating that the train has been stopped within a predetermined distance from the upcoming signal, the train is not automatically braked.

17. The train control system of claim 16, wherein, further based upon train control data indicating that the train is operating at a specified speed within a predetermined distance from the upcoming signal, the train is not automatically braked.

18. The train control system of claim 10, wherein, based upon train control data indicating that the train is operating at a specified speed within a predetermined distance from the upcoming signal, the train is not automatically braked.

19. The train control system of claim 1, further comprising a visual display device in communication with the onboard control system, wherein the visual display device is configured to display a prompt to an operator of the train.

20. The train control system of claim 19, wherein the displayed prompt includes a query requesting whether the operator is permitted to pass the upcoming signal without stopping the train.

21. The train control system of claim 20, wherein prior to displaying the prompt, the onboard control system is further configured to receive specified train control data indicating at least one of the following: data indicating that the train has been stopped within a predetermined distance from the upcoming signal; data indicating that the train is operating at a specified speed within a predetermined distance from the upcoming signal; data indicating that authorization to proceed has been obtained or any combination thereof.

22. The train control system of claim 19, wherein the onboard control system is configured to determine authorization data based upon the operator's interaction with the displayed prompt.

23. A method for controlling at least one train travelling in a track network comprising at least one track having at least one signal associated with a portion of the at least one track, the method comprising:

determining at least one of the following: train data, track network data, track data, signal data;

determining position data directed to a position of the at least one train within the track network; and based upon at least one of the following: train data, track network data, track data, position data, signal data, train control data, authorization data signal aspect data, or any combination thereof, predictively enforcing the next, upcoming signal with a train control system by automatically braking the at least one train prior to encountering the next, upcoming signal, unless: (a) based at least partially on current signal aspect data, a determination is made that it is safe to proceed towards the next, upcoming signal; (b) specified authorization data is received; or (c) specified train control data is received.

24. A train control system for predictively enforcing a stop for at least one train travelling in a track network having at least one track with at least one signal associated with a portion of the at least one track, the system comprising an onboard control system configured to: (i) receive train position data and signal data; (ii) display a prompt to an operator of the at least one train for specified authorization data to allow the at least one train to proceed without operational compliance of a next, upcoming signal, unless specified train control data indicating operational compliance of the at least one train for the next, upcoming signal is received prior to encountering the next, upcoming signal; and (iii) based upon at least one of the following: train data, track network data, track data, position data, signal data, train control data, authorization data signal aspect data, or any combination thereof, predictively enforce the next, upcoming signal by automatically braking the at least one train prior to encountering the next, upcoming signal, unless: (a) based at least partially on current signal aspect data, a determination is made that it is safe to proceed towards the next, upcoming signal; (b) the specified authorization data is received; or (c) the specified train control data is received.

* * * * *